US007194824B2

(12) United States Patent
Wang

(10) Patent No.: US 7,194,824 B2
(45) Date of Patent: Mar. 27, 2007

(54) CLOTHES DRYING APPARATUS

(75) Inventor: Bong Hyun Wang, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/897,010

(22) Filed: Jul. 23, 2004

(65) Prior Publication Data

US 2005/0102853 A1 May 19, 2005

(30) Foreign Application Priority Data

Nov. 17, 2003 (KR) ..... 10-2003-0081243

(51) Int. Cl.
*F26B 11/02* (2006.01)

(52) U.S. Cl. ..... 34/602; 68/19

(58) Field of Classification Search ..... 34/601–606, 34/595; 68/131, 19, 140
See application file for complete search history.

(56) References Cited

U.S. PATENT DOCUMENTS

| | | | | |
|---|---|---|---|---|
| 857,161 | A * | 6/1907 | Cummer | 432/109 |
| 3,017,758 | A * | 1/1962 | Haverstock et al. | 68/19 |
| 3,022,656 | A | 2/1962 | Bergeson et al. | |
| 3,038,639 | A | 6/1962 | Anderson | |
| 3,643,341 | A * | 2/1972 | Magin | 34/444 |
| 3,815,258 | A * | 6/1974 | Beard, Jr. | 34/602 |
| 4,519,145 | A * | 5/1985 | Mandel | 34/389 |
| 5,371,956 | A * | 12/1994 | St. Louis | 34/599 |
| 5,463,821 | A * | 11/1995 | Gauer | 34/261 |
| 5,709,109 | A * | 1/1998 | Cho | 68/23.2 |
| 5,782,111 | A * | 7/1998 | Sights et al. | 68/142 |

FOREIGN PATENT DOCUMENTS

| | | |
|---|---|---|
| DE | 40 21 533 | 1/1992 |
| DE | 102 27 957 | 1/2004 |
| EP | 0 655 523 | 5/1995 |
| EP | 1 270 794 | 1/2003 |
| EP | 1 350 880 | 10/2003 |

(Continued)

OTHER PUBLICATIONS

European Search Report for Application No. 06250035.0; dated Jul. 24, 2006.

(Continued)

*Primary Examiner*—S. Gravini
(74) *Attorney, Agent, or Firm*—Staas & Halsey LLP

(57) ABSTRACT

A clothes drying apparatus in which lifters arranged on an inner peripheral surface of a rotating drum, while extending axially along the rotating drum, have an improved structure to achieve an enhancement in drying performance. The clothes drying apparatus includes a rotating drum to contain clothes to be dried, and a plurality of lifters arranged on the inner peripheral surface of the rotating drum. Each lifter has at least one first step surface, and a second step surface. The first and second step surfaces are arranged at different levels to form a stepped structure, so that they cause the clothes to be easily dropped after being raised by the lifter. A pair of first step surfaces are arranged at opposite end portions of the lifter, respectively, and the second step surface is arranged between the first step surfaces at a level lower than that of the first step surfaces.

3 Claims, 4 Drawing Sheets

FOREIGN PATENT DOCUMENTS

| | | |
|---|---|---|
| EP | 1 445 368 | 8/2004 |
| GB | 2 029 862 | 3/1980 |
| JP | 03280998 | 12/1991 |
| JP | 04152990 | 5/1992 |
| KR | 10-0388702 | 11/2003 |

OTHER PUBLICATIONS

European Search Report for Application No. 04018418.6 dated Aug. 31, 2006.

* cited by examiner

CLOTHES DRYING APPARATUS

CROSS-REFERENCE TO RELATED APPLICATIONS

This application claims the benefit of Korean Patent Application No. 2003-81243, filed on Nov. 17, 2003 in the Korean Intellectual Property Office, the disclosure of which is incorporated herein by reference.

BACKGROUND OF THE INVENTION

1. Field of the Invention

The present invention relates to a clothes drying apparatus, and more particularly to a clothes drying apparatus in which lifters, arranged on an inner peripheral surface of a rotating drum while extending axially along the rotating drum, have an improved structure to achieve an enhancement in drying performance.

2. Description of the Related Art

Generally, clothes drying machines are adapted to dry clothes contained in a rotating drum, horizontally arranged in a housing, by a flow of hot air passing through the rotating drum during rotation of the rotating drum at low speed in one direction.

Such a clothes drying machine includes a rotating drum receiving clothes to be dried, an intake duct supplying hot air into the rotating drum, an exhaust duct venting the hot air exhausted after circulating the rotating drum, and a driving unit rotating the rotating drum to rapidly dry the clothes.

A heater is installed in the intake duct to increase the temperature of the air introduced into the intake duct. An exhaust fan is installed in the exhaust duct to forcibly vent hot air introduced into the rotating drum through the intake duct.

The driving unit includes a drive motor generating a rotating force, and a belt connected to a rotating shaft of the drive motor while being wound on an outer peripheral surface of the rotating drum. When the drive motor operates, the belt is rotated, thereby rotating the rotating drum.

A plurality of lifters are arranged on an inner peripheral surface of the rotating drum while extending axially along the rotating drum. To more rapidly and effectively dry clothes contained in the rotating drum, the lifters raise the clothes to the top of the rotating drum, and then release the clothes to cause the clothes to be dropped to the bottom of the rotating drum, in accordance with the rotation of the rotating drum.

In the clothes drying machine having the above mentioned configuration, as the drive motor, exhaust fan, and heater operate, the rotating drum is rotated at low speed, and hot air is introduced into the rotating drum through the intake duct. Accordingly, the clothes contained the rotating drum come into contact with the introduced hot air while being downwardly dropped by the lifters, so that they are dried. The air, which has increased humidity due to its absorption of humidity from the clothes coming into contact therewith, is forcibly vented from the clothes drying machine through the exhaust duct.

In this clothes drying machine, however, the clothes may be continuously rotated in a state of being held on the lifters during rotation of the rotating drum, without being dropped after being raised to the top of the rotating drum by the lifters in accordance with the rotation of the rotating drum, because each lifter has an axial structure, with respect to the rotating drum, throughout the length thereof. As a result, the clothes come into insufficient contact with hot air, so that they may be ineffectively dried. Furthermore, there is a drawback in that a prolonged drying operation is required.

SUMMARY OF THE INVENTION

The present invention has been made in view of the above and/or other problems, and an aspect of the invention is to provide a clothes drying apparatus in which lifters arranged on the inner peripheral surface of a rotating drum, while extending axially along the rotating drum, have an improved structure to achieve an enhancement in drying performance.

In accordance with the present invention, this and/or other aspects are accomplished by providing a clothes drying apparatus having: a rotating drum to contain clothes to be dried; and a plurality of lifters arranged on an inner peripheral surface of the rotating drum, wherein each lifter has a stepped structure causing the clothes to be easily released from the lifter after being raised by the lifter.

According to one aspect, each lifter has at least one first step surface, and a second step surface, the first and second step surfaces being arranged at different levels to form the stepped structure.

According to one aspect, the at least one first step surface is a pair of first step surfaces respectively arranged at opposite end portions of the lifter, and the second step surface is arranged between the first step surfaces at a level lower than that of the first step surfaces.

According to another aspect, the at least one first step surface is a pair of first step surfaces respectively arranged at opposite end portions of the lifter, and the second step surface is arranged between the first step surfaces at a level higher than that of the first step surfaces.

Additional aspects and/or advantages of the invention will be set forth in part in the description which follows, and in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
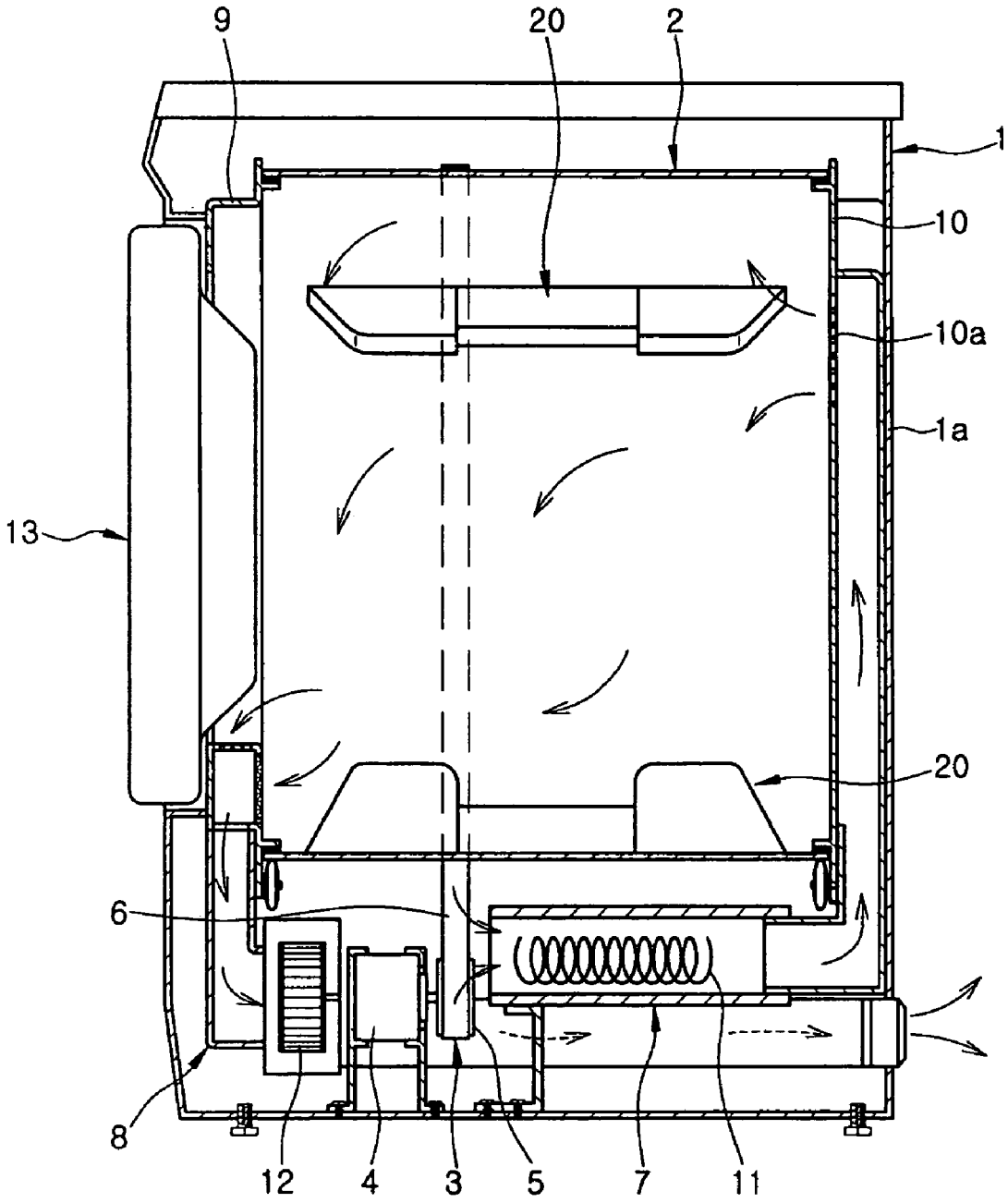
FIG. 1 is a sectional view schematically illustrating a clothes drying apparatus according to an embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

FIG. 1 is a sectional view schematically illustrating a clothes drying apparatus according to an embodiment of the present invention. As is shown in FIG. 1, the clothes drying apparatus includes: a housing 1 having an approximately box shape to define an appearance of the clothes drying apparatus; a rotating drum 2 installed in the housing 1 and adapted to receive clothes to be dried; a driving unit 3 rotating the rotating drum 2 to rapidly dry the clothes, and intake and exhaust ducts 7 and 8 circulating ambient air through the rotating drum 2.

The rotating drum 2 is opened at front and rear ends thereof. Front and rear panels 9 and 10 are mounted to the front and rear ends of the rotating drum 2, respectively, to close the rotating drum 2 while allowing the rotating drum 2 to rotate with respect therewith.

The driving unit 3 includes a drive motor 4 generating a rotating force, a pulley 5 coupled to a rotating shaft of the drive motor 4, and a belt 6 wound on an outer peripheral surface of the rotating drum 2 and the pulley 5. With this structure, when the drive motor 4 rotates at low speed, the belt 6 is rotated along with the pulley 5, thereby causing the rotating drum 2 torotate.

The intake duct 7 is opened at its inlet portion while being connected, at its outlet portion, to the rear panel 10. A heater 11 is arranged in the intake duct 7 to heat air introduced into the intake duct 7.

To introduce ambient air into the intake duct 7, intake holes (not shown) are positioned at a rear wall plate 1*a* of the housing 1. Through holes 10*a* are also positioned at the rear panel 10 to introduce hot air from the intake duct 7 into the rotating drum 2.

The exhaust duct 8 is connected, at its inlet portion, to the front panel 9 while being opened at its outlet portion. The outlet portion of the exhaust duct 8 extends externally beyond the housing 1. Accordingly, ambient air around the housing 1 can be introduced into the rotating drum 2 via the intake duct 7, and then forcibly vented out of the housing 1 via the exhaust duct 8.

A door 13 is hingably coupled to a front wall of the housing 1, so that clothes to be driedmay be placed in the rotating drum 2 through an opening of the front panel 9, and dried clothes may be removed from the rotating drum 2.

A plurality of lifters 20 are arranged on the inner peripheral surface of the rotating drum 2 while being uniformly circumferentially spaced apart from one another. The lifters 20 serve to raise the cloths to the top of the rotating drum 2, and then release the clothes at a desired level to cause the clothes to be dropped to the bottom of the rotating drum 2, in accordance with rotation of the rotating drum, to cause the clothes to be uniformly dried.

The structure of the lifters will now be described with reference to FIGS. 2 to 4.

Figure 2:
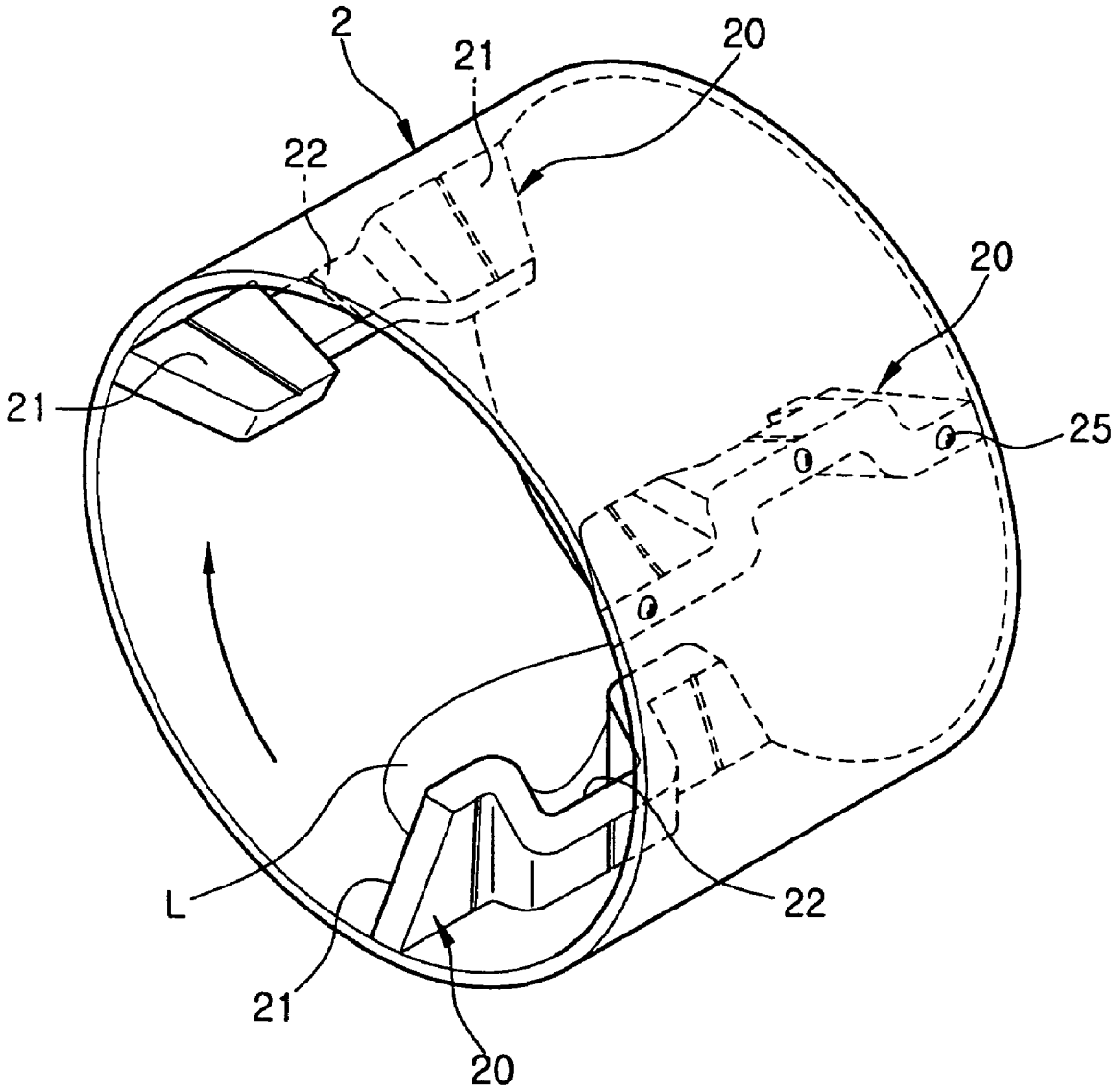
FIG. 2 is a perspective view illustrating lifters of FIG. 1.

FIG. 2 is a perspective view illustrating the lifters 20 of FIG. 1. FIGS. 3 and 4 are front and rear perspective views of one of the lifters 20, respectively.

Referring to FIG. 2, the rotating drum 2 is opened at its front and rear ends. During a drying process, the rotating drum 2 is rotated at low speed in one direction (indicated by an arrow in FIG. 2) by the belt 6 (FIG. 1). As is shown in FIG. 2, the lifters 20 are arranged on the inner peripheral surface of the rotating drum 2 such that they are uniformly circumferentially spaced apart from one another, while extending axially along the rotating drum 2.

When the rotating drum 2 rotates at low speed in the direction indicated by the arrow in FIG. 2, the clothes contained in the rotating drum 2 are raised from the bottom of the rotating drum 2 by the lifters 20, and then released from the lifters 20 at the top of the rotating drum 2, so that they are dropped onto the bottom of the rotating drum 2. Thus, the clothes can come into uniform contact with hot air passing through the rotating drum 2, so that they can be rapidly and uniformly dried.

Figure 3:
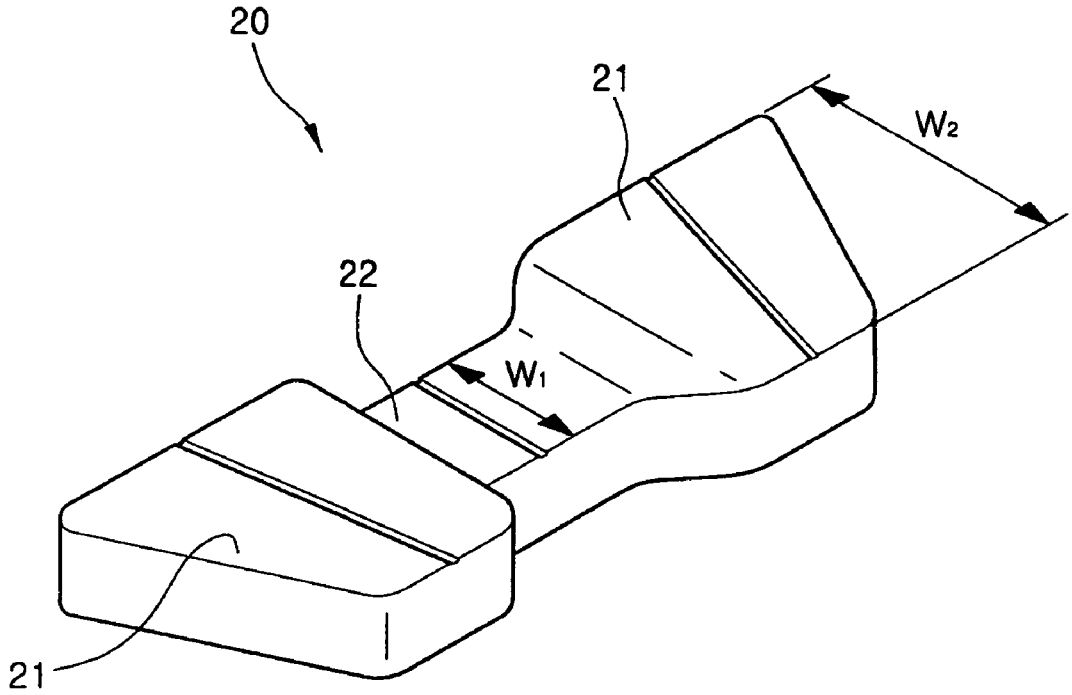
FIG. 3 is a front perspective view of one lifter of FIG. 1.

As is shown in FIG. 3, each lifter 20 has a stepped structure to prevent the clothes from remaining attached to the surface of the lifter 20 without being released from the lifter 20 at the top of the rotating drum 2. That is, the lifter 20 has step surfaces of different levels.

According to one aspect, the lifter 20 has a pair of first step surfaces 21 arranged at front and rear end portions of the lifter 20 while being flush with each other, and a second step surface 22 arranged between the first step surfaces 21 at a level lower than that of the first step surfaces 21. Thus, the lifter 20, which is adapted to raise clothes contained in the rotating drum 2, has a stepped structure at its surface. The second step surface 22 arranged at a lower level has a width W1 smaller than a width W2 of the first step surfaces 21 arranged at a higher level. According to another aspect (not shown), additional first and second step surfaces 21 and 22 are arranged on the lifter 20, such that the first step surfaces 21 are arranged at a level higher than those of the step surfaces 22.

Accordingly, the lifter 20 has, at its upper surface contacting the clothes to raise it, higher-level portions defined by respective first step surfaces 21, and a lower-level portion defined by the second step surface 22. According to another aspect (not shown), the second step surface 22 is arranged at a level higher than that of the first step surfaces 21, while being interposed between the first step surfaces 21. In this case, the lifter 20 has a stepped structure in which the intermediate portion of the lifter 20 is arranged at a level higher than that of the front and rear end portions of the lifter 20. According to yet another aspect (not shown), additional first and second step surfaces 21 and 22 are arranged on the lifter 20, such that the second step surfaces 22 are arranged at levels higher than those of the first step surfaces 21.

With the above described stepped structure of the lifter 20, clothes or laundry L (FIG. 2), which is arranged just over the lifter 20, is raised by the lifter 20 without coming into contact with the upper surface portion of the lifter 20 corresponding to the second step surface 22, so that it can be easily released from the lifter 20 when the lifter 20 is moved to the top of the rotating drum 2.

Figure 4:
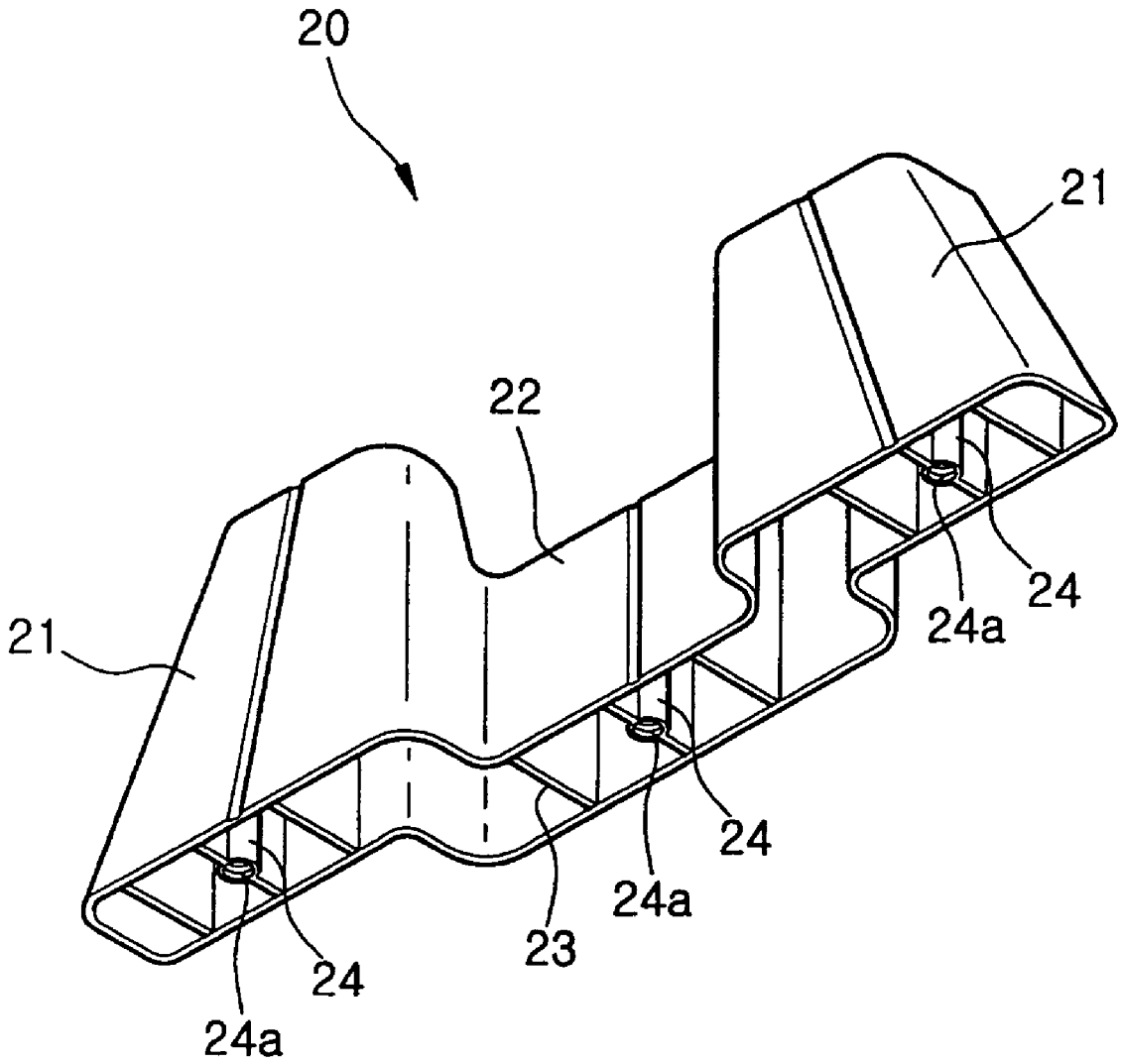
FIG. 4 is a rear perspective view of the lifter of FIG. 1.

As is shown in FIG. 4, the lifter 20 is opened at a fixing end thereof to fix the lifter 20 in a state of being in contact with the inner peripheral surface of the rotating drum 2. A plurality of ribs 23 and bosses 24 are provided at the lifter 20 such that they extend from the opened fixing end of the lifter 20 into an interior of the lifter 20.

Each boss 24 has a threaded coupling hole 24*a*, to which a screw 25 (FIG. 2) will be threadedly coupled at the outside of the rotating drum 2, in order to fix the lifter 20 to the inner peripheral surface of the rotating drum 2.

According to another aspect (not shown), the lifters 20 are integrally formed with the rotating drum 2.

Now, the process of drying clothes by the clothes drying apparatus having the above described configuration according to the illustrated embodiment of the present invention will be described.

First, the user puts the clothes to be dried into the rotating drum 2, and then closes the door 13. When the user subsequently operates the drive motor 4, exhaust fan 12, and heater 11, the rotating drum 2 is rotated at low speed in the direction indicated by the arrow in FIG. 2. Simultaneously, ambient air around the housing 1 is introduced into the intake duct 7.

In accordance with the rotation of the rotating drum 2, the clothes are sequentially upwardly raised from the bottom of the rotating drum by the lifters 20, and then dropped from the top of the rotating drum 2 onto the bottom thereof. The air introduced into the intake duct 7 is heated by the heater

11, and then fed to the rotating drum 2 through the through holes 10*a* of the rear panel 10.

Thus, the hot air introduced into the rotating drum 2 rapidly and uniformly dries the clothes periodically tumbled by the lifters 20, while passing through the rotating drum 2.

During this drying process, the clothes are upwardly raised from the bottom of the rotating drum 2 by the lifters 20 in a sequential fashion without coming into contact with the second step surface 22 of each lifter 20. Accordingly, the clothes are easily released from the lifters 20 when each lifter 20 reaches a certain level, so that they are dropped onto the bottom of the rotating drum 2.

Meanwhile, the air, which has increased humidity due to its absorption of humidity from the clothes coming into contact therewith, is vented out of the housing 1 through the exhaust duct 8. Simultaneously, fresh air is introduced into the intake duct 7, heated while passing through the intake duct 7, and is then introduced into the rotating drum 2. As this process is repeatedly carried out, the clothes are completely dried.

As is apparent from the above description, the clothes drying apparatus according to the present invention uniformly dries clothes while achieving a reduction in drying time because its lifters have a stepped structure that allows the clothes to be easily released from the surface of each lifter. Accordingly, there is an enhancement in drying performance.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A clothes drying apparatus, comprising:

a rotating drum with an approximately constant external diameter, to contain clothes to be dried; and a plurality of lifters arranged on an inner peripheral surface of the rotating drum, wherein an external surface of each lifter has at least one first step surface and a second step surface, the first and second step surfaces being arranged at different radial and circumferential levels to form an axially, radially, and circumferentially stepped structure causing the clothes to be easily released from the lifter after being raised by the lifter.

2. The clothes drying apparatus according to claim 1, wherein the at least one first step surface comprises a pair of first step surfaces respectively arranged at opposite end portions of the lifter, and the second step surface is arranged between the first step surfaces at a level lower than that of the first step surfaces.

3. The clothes drying apparatus according to claim 1, wherein the at least one first step surface comprises a pair of first step surfaces respectively arranged at opposite end portions of the lifter, and the second step surface is arranged between the first step surfaces at a level higher than that of the first step surfaces.

* * * * *